US005236744A

United States Patent [19]

Suga et al.

[11] Patent Number: 5,236,744

[45] Date of Patent: Aug. 17, 1993

[54] COATING METHOD

[75] Inventors: Yasushi Suga; Kiyoshi Kobayashi; Toshimitsu Sasahara; Kimiaki Miyamoto, all of Kanagawa, Japan

[73] Assignee: Fuji Photo Film Co., Ltd., Kanagawa, Japan

[21] Appl. No.: 605,297

[22] Filed: Oct. 30, 1990

[30] Foreign Application Priority Data

Oct. 31, 1989 [JP] Japan ..... 1-282028

[51] Int. Cl.[5] ..... B05D 1/30

[52] U.S. Cl. ..... 427/420; 118/DIG. 4

[58] Field of Search ..... 427/420; 118/DIG. 4

[56] References Cited

U.S. PATENT DOCUMENTS

| | | | |
|---|---|---|---|
| 3,508,947 | 4/1970 | Hughes | 118/324 X |
| 3,632,374 | 6/1968 | Greiller | 118/324 X |
| 4,135,477 | 1/1979 | Ridley | 118/325 |
| 4,842,900 | 6/1989 | Miyamoto | 427/348 |

FOREIGN PATENT DOCUMENTS

| | | |
|---|---|---|
| 2285931 | 9/1975 | France . |
| 50-76151 | 6/1975 | Japan . |
| 62-197176 | 8/1987 | Japan . |
| 64-51170 | 2/1989 | Japan . |
| 1-051170 | 2/1989 | Japan . |
| 1-131549 | 5/1989 | Japan . |

*Primary Examiner*—Marianne Padgett

*Attorney, Agent, or Firm*—Sughrue, Mion, Zinn, Macpeak & Seas

[57] ABSTRACT

A slide-hopper-type coating method in which the viscosity of the coating solution forming a free-falling curtain and the angle $\alpha$ which the front edge of the lip of the slide hopper forms with respect to the horizontal are selected with respect to the flow rate of the curtain in such a way that the line of contact between the curtain and the web is concave with respect to the direction in which the web travels. In addition, the angle $\beta$ which the extension of the curtain in the direction of its fall forms with respect to the direction of travel of the web at the point where the curtain is deposited on the web is preferably adjusted so that it is an obtuse angle not larger than 140°. By satisfying these conditions, the coating method of the present invention is capable of extending the upper limit of coating speeds without causing "sagging" in the range of high flow quantities of coating solution per unit length of curtain coat width.

2 Claims, 2 Drawing Sheets

COATING METHOD

BACKGROUND OF THE INVENTION

1. Field of the Invention

The present invention relates to a method by which various liquid compositions are curtain-coated onto a continuously running support in strip form (hereinafter referred to as a "web") in the manufacture of photographic films, photographic papers, magnetic recording tapes, adhesive tapes, pressuresensitive recording papers, offset printing plates, or the like.

2. Background of the Related Art

The basic technology of curtain coating is described in U.S Pat. Nos. 3,508,947 and 3,632,374. In "AIChE Winter National Meeting" (1982), S. F. Kistler disclosed the theory of curtain coating, focusing on the following three phenomena which he considered would govern the rate of application by curtain coating:

(1) incorporation of tiny air bubbles between the web and the coating solution (which phenomenon is hereinafter referred to as "air entrainment");

(2) formation of a liquid deposit along the line where the coating solution contacts the web (which phenomenon is hereinafter referred to as "heel" and is common when the coating solution flow rate is large); and (3) the coating solution is not adequately deposited but will bounce back from the web being coated (which phenomenon is caused by "heel with air entrainment" and is hereinafter referred to as "sagging" and i also common when the coating solution flow rate is large).

According to Kistler, curtain coating is no longer possible if one or more of these phenomena occur.

Various attempts have previously been made to increase the curtain coating speed limited by the aforementioned phenomena. They include:

(1) replacing the web-entrained air layer with carbon dioxide to suppress the phenomenon of "air entrainment" (see U.S. Pat. No. 4,842,900); and (2) applying a static electric field between the web and the coating solution, whereby the adhesion of the latter is enhanced to suppress the phenomenon of "air entrainment" (see Unexamined Published Japanese Patent Application No. 197176/1987).

In fact, however, as modern coating plants adopt application speeds of 250 m/min and higher with the curtain of coating solution flowing in higher rates, the limitation of coating speeds by "heel" and "sagging" has become a greater concern than the limitation by "air entrainment". A method that has previously been proposed for dealing with this problem is:

(3) suppressing the phenomenon of "heel" by properly adjusting the shearing viscosity between the lower and upper layers of coating solution (see Unexamined Published Japanese Patent Application No. 131549/1989).

A method of curtain coating has also been proposed for insuring that a curtain forms consistently, even if the coating solution is allowed to flow in comparatively low rates, to thereby prevent the thickness of the curtain from being unduly increased at the two lateral edges, which method is:

A multiple curtain coating including the steps of forming at least two layers of a coating solution on an inclined sliding surface, allowing the superposed layers to fall down a curved lip portion at the terminal end of the sliding surface, and permitting the resulting free-falling curtain to be deposited on a running support, wherein the angle $\beta$ at which the sliding surface is inclined with respect to the horizontal is 30°-70°. This surface at which the curved lip portion contacts the superposed layers of coating solution is a cylindrical surface having a radius of curvature of at least 40 mm. This method may be modified such that the direction in which the curtain falls down forms an angle $\beta$ of 120°-150° with respect to the direction of travel of the web at the point where the curtain is deposited on the support (see Unexamined Published Japanese Patent Application No. 51170/1989). The techniques described in Unexamined Published Japanese Patent Application No. 51170/1989 and 131549/1989 are such that the flow rate of the curtain of coating solution is in the range of 1.0-4.0 $cm^3/cm \cdot sec$ (the unit length of coating width being expressed in centimeters). Those techniques are effective in the specified range for forming a consistent curtain and preventing its thickness from being unduly increased at both lateral edges. However, no study has been made to determine whether they are effective in suppressing the phenomenon of "sagging" in flow rates exceeding 4 $cm^3/cm \cdot sec$.

SUMMARY OF THE INVENTION

An object, therefore, of the present invention is to solve the aforementioned problems of the prior art by providing a coating method that is capable of extending the upper limit of coating speeds without causing "sagging" at high flow rates in the range of 3-7 $cm^3/cm \cdot sec$ (the unit length of curtain coating width being expressed in centimeters).

In the course of intensive studies conducted to attain the aforementioned object, the present inventors noted that the shape of the line Of contact between the free-falling curtain of coating solution and the web was important. The present invention was accomplished on the basis of this finding.

The aforementioned object of the present invention can be attained in a coating method which consist of allowing a free-falling curtain of coating solution to impinge against a continuously running web, wherein the viscosity of the coating solution and the angle $\alpha$, which the front edge of the lip of a slide hopper forms with the horizontal are selected with respect to the flow rate of the free falling curtain in such a way that the line of contact between the free falling curtain and the web is concave with respect to the direction in which the web travels, the degree of concavity being at least 3 mm. Preferably, the angle $\beta$, which an extension of the free falling curtain in the direction of its fall forms with respect to the direction of travel of the web at the point where the curtain is deposited on the web, is an obtuse angle not larger than 140°.

The novel characteristic feature of the present invention is that the viscosity of the coating solution being applied and the angle which the front edge of the lip of a slide hopper forms with respect to the horizontal are preselected with respect to the flow rate of the free falling curtain of the coating solution, in such a way so that the line of contact between the free falling curtain and the web is concave with respect to the direction in which the web travels, with the degree of concavity being at least 3 mm.

DESCRIPTION OF THE PREFERRED EMBODIMENTS

Figure 1A:
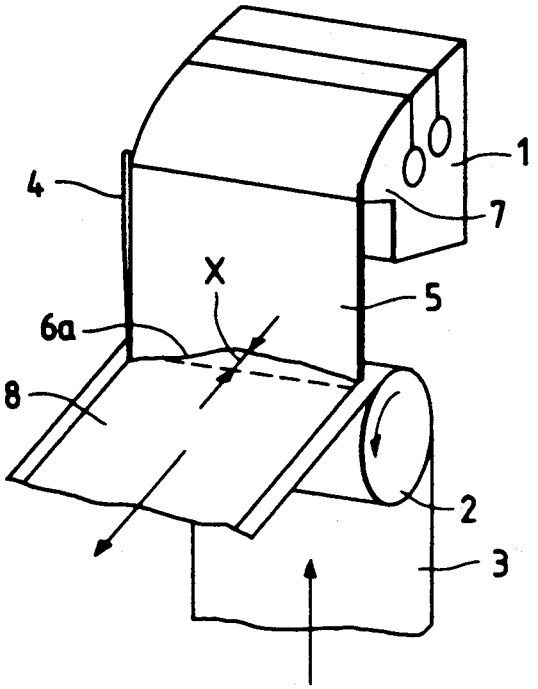
FIG. 1(*a*) and (*b*) are is a perspective view illustrating two shapes of the line of contact between a web and a free-falling curtain that is formed of the coating solution supplied from a slide hopper.
Figure 1B:
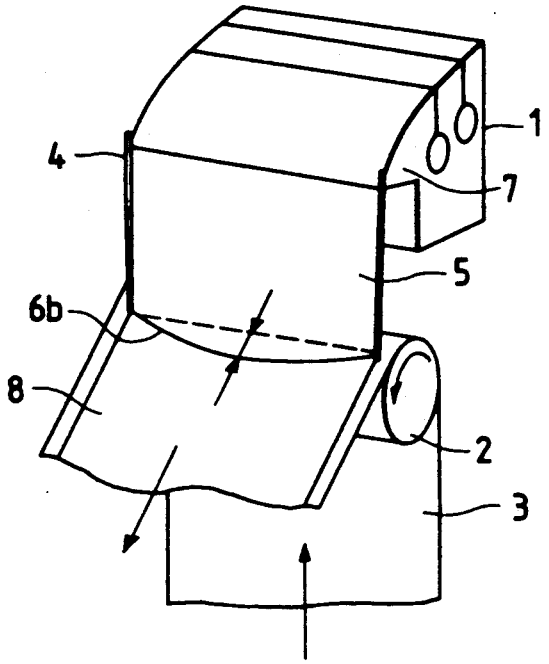

The present invention will now be described below in further detail with reference to the accompanying drawings. FIG. 1(*a*) is a perspective view showing a concave line of contact between the web and the free-falling curtain of coating solution that is flowing down a slide hopper, and FIG. 1(*b*) is a perspective view showing a convex line of contact between the web and the free-falling curtain.

As shown, the coating solution flowing down the inclined surface of a slide hopper 1 is supported by rods 4 along two sides to form a free-falling curtain 5, which impinges against the web 3 to be coated thereon along the line of contact 6.

According to the present invention, the line of contact is made concave, as indicated at 6*a* in FIG. 1(*a*), and the degree of concavity x, as measured at the center of the line of contact, is no smaller than 3 mm. By forming a free-falling curtain that satisfies these requirements, consistent and rapid curtain coating can be accomplished. The condition of $x \geqq 3$ mm means that the distance from the line connecting the two supporting rods at an end to the bottom of the concave portion at the center of the curtain should be at least 3 mm. If $x < 3$ mm, the purpose of the present invention (i.e., increasing the upper limit of coating speed) cannot be fully achieved.

Figure 2:
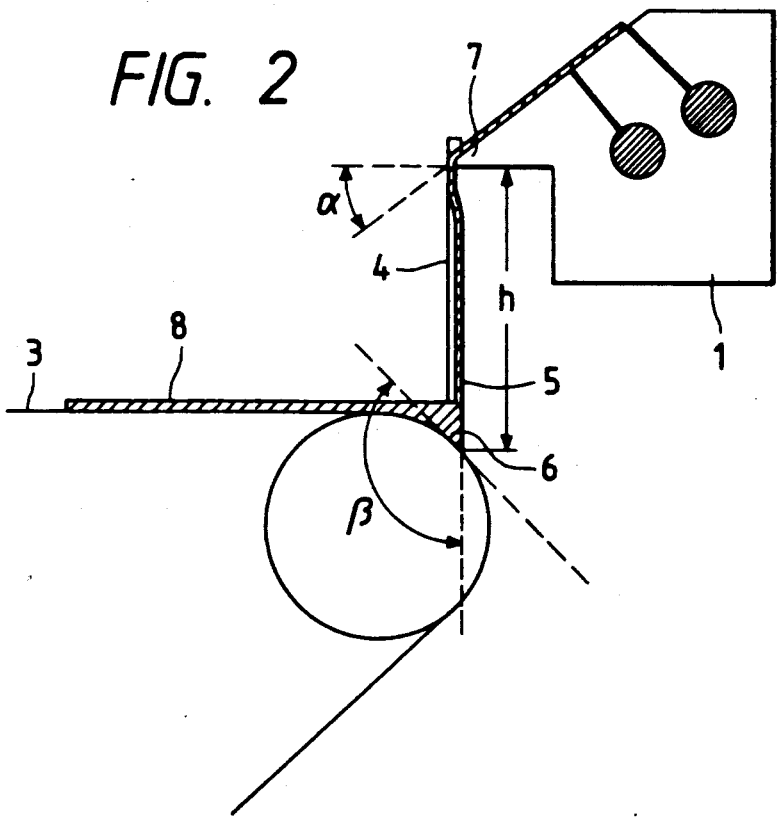
FIG. 2 is a side view illustrating various dimensions of a slide hopper type curtain coater a they relate to the present invention.

FIG. 2 is a side view showing how curtain coating is performed with the coating solution supplied from a slide hopper. In the present invention, the angle $\beta$, which is formed between the direction in which the free-falling curtain 5 flows down and the direction of travel of the web 3 at the point where the curtain is deposited on the web, may be an obtuse angle not larger than 140°, which is effective for meeting the two requirements described above, namely, the line of contact between the free-falling curtain 5 and the web 3 should be made concave with respect to the direction of travel of the web, and the degree of concavity should be at least 3 mm.

In the present invention, the angle $\alpha$ which the front edge 7 of the lip of the slide hopper 1 forms with respect to the horizontal can be adjusted by modifying the shape of the front edge 7. Through adjustment of the angle $\alpha$, not only the flow rate at which the coating solution leaves the slide hopper 1 to form the free-falling curtain 5 but also the shape of the curtain will change. The angle $\alpha$ can also be adjusted by changing the inclination of the slide hopper. This technique of changing the inclination of a fluid supplier has not been practiced with conventional curtain coaters.

Figure 3A:
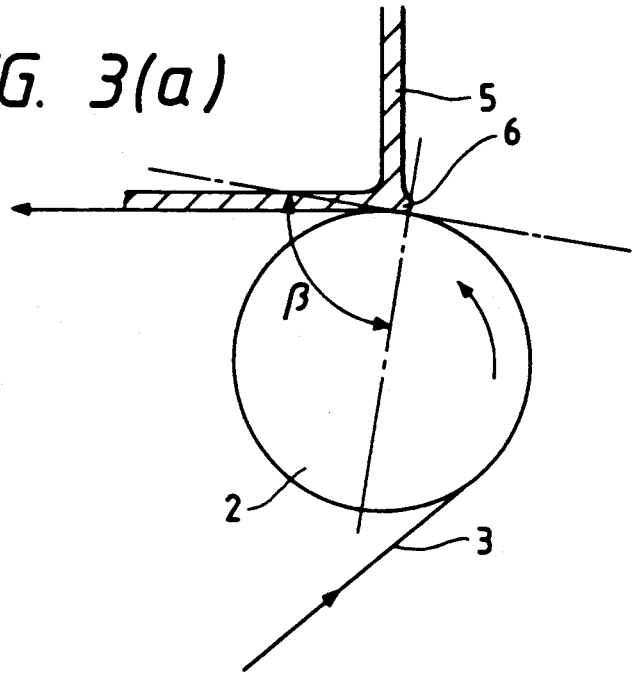
FIG. 3(*a*) and (*b*) are partial side views illustrating the angle $\beta$ which the extension of the free-falling curtain in the direction of its fall forms with respect to the direction of travel of the web at the point where the curtain is deposited on the web.
Figure 3B:
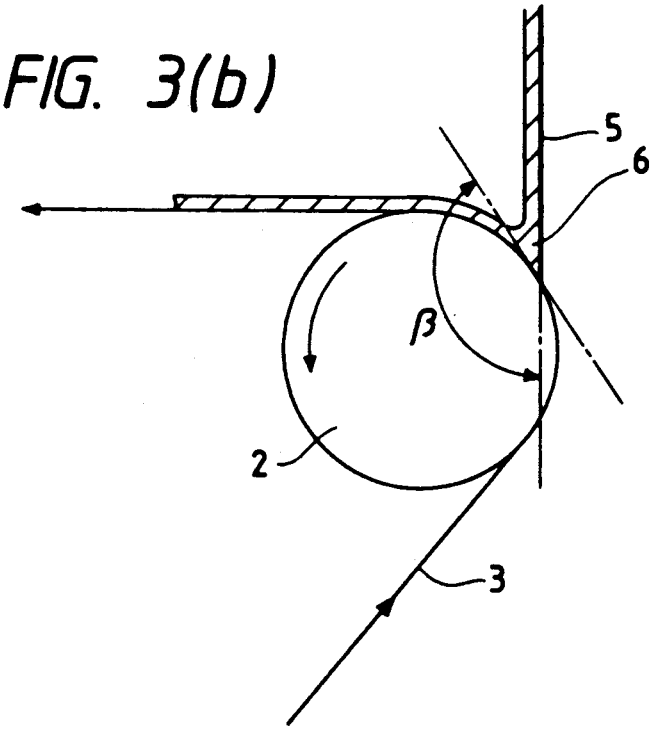

In the present invention, the angle $\beta$ at which the free-falling curtain is deposited on the web may be adjusted, by changing the position of roller 2 or slide hopper 2, which allows the curtain to be deposited on the web at different points, as indicted at 6 in FIGS. 3(*a*) and 3(*b*). In FIG. 3(*a*), $\beta$ is nearly equal to 90°, and in FIG. 3(*b*), $\beta$ is nearly equal to 140°. If $\beta > 140°$, the free-falling curtain is unable to form a consistent line of contact 6 with the web. Selection of the proper point of deposition requires the fluid supplier to be precisely adjusted in the direction of travel of the web.

Through precise adjustment of the viscosity of the coating solution and the inclination of the slide hopper as well as its distance to the web in either the horizontal or vertical direction, the upper limit of coating speeds can be extended.

EXAMPLE

An aqueous solution of 10% alkali-processed gelatin containing 0.15 wt% of an anionic surfactant (sodium salt of 2-ethylhexyl $\alpha$-sulfosuccinate) was treated with poly(sodium styrenesulfonate) so as to increase its viscosity to 30 cps or 60 cps at a shear rate of 10 $sec^{-1}$. The thus-prepared samples of coating solution were applied onto webs (polyethylene-laminated papers) using a slide hopper, with the flow rate q of the free-falling curtain per unit length of the coat width being varied at 2, 3, 4 or 6 ($cm^3$/cm·sec). During the application, the distance h between the lip portion of the slide hopper and the point at which the curtain was deposited was held at 100 mm; on the other hand, the angle $\alpha$ which the front edge of the lip of the slide hopper formed with the horizontal was varied at about 435°, 90° and 120°, whereas the angle $\beta$ at which the curtain was deposited on the webs was varied at about 90° and 120°. the results of comparison of the coating speeds that could be achieved in these various cases are shown in Table 1.

TABLE 1

| Run No. | Flow quantity | Viscosity | x | $\alpha$ | $\beta$ | Limit casting speed |
|---|---|---|---|---|---|---|
| 1 | 3 | 30 | 11.0 | 45 | 90 | 210 |
| 2 | 6 | 30 | 28.0 | 120 | 90 | 340 |
| 3 | 4 | 60 | 7.5 | 45 | 90 | 320 |
| 4 | 4 | 60 | 9.5 | 90 | 90 | 350 |
| 5 | 4 | 60 | 11.6 | 90 | 125 | 400 |
| 6 | 2 | 60 | 0 | 45 | 90 | 300 |
| 7 | 6 | 30 | −10 | 45 | 90 | 150 |
| 8 | 6 | 60 | −7 | 45 | 90 | 200 |

Units of measurement: flow rate, $cm^3$/cm·sec; viscosity, cps; x, mm; coating speed, m/min; $\alpha$, $\beta$, degrees.

Symbol x represents the distance of the bottom or peak at the center of the line of contact as measured from the line connecting the support rods on two sides of the web; when $x > 0$, the line of contact was concave with respect to the direction of travel of the web, and when $x < 0$, the line of contact was convex.

Table 1 shows the following:

(1) Given the same flow rate, the limit coating speed increased with increasing concavity of the line of contact when the viscosity of the coating solution was higher than a certain value (compare Runs Nos. 3, 4 and 5), which allowed the coating operation to be performed at higher speeds.

(2) When the viscosity of the coating solution was low for a given flow rate, the line of contact was convex, thereby reducing the limit coating speed.

(3) The more the angle $\alpha$ increased beyond 45°, the more likely it was for the line of contact to become concave (compare Runs Nos. 3 and 4); and (4) The line of contact was more likely to become concave when $\beta$ was 125° than when it was 90°.

In the present invention, the viscosity of the coating solution forming a free-falling Curtain and the angle $\alpha$ which the front edge of the lip of a slide hopper forms with respect to the horizontal are selected with respect to the flow rate of the curtain in such a way that the line of contact between the curtain and the web is concave with respect to the direction in which the web travels. In addition, the angle $\beta$ which the extension of the curtain in the direction of its fall forms with respect to the direction of travel of the web at the point where the curtain is deposited on the web may be so adjusted that it is an obtuse angle not larger than 140°. By satisfying these conditions, the coating method of the present invention is capable of extending the upper limit of coating speeds without causing "sagging" in the range of high flow rates of coating solution per unit length of curtain coat width, which contributes to a marked improvement in productivity.

What is claimed is:

1. In a coating method in which a curtain of coating solution free falling from a slide hopper coating head impinges against a continuously running web, the improvement wherein a viscosity of said coating solution being applied and an angle $\alpha$, which a front edge tip of a lip of said slide hopper forms with respect to the horizontal, are selected with respect to a flow rate of a free-falling curtain of said solution in such a way that a line of contact between said curtain and said web is concave with respect to a horizontal direction in which said web travels, said line having a center point which is at least 3 mm further in said horizontal direction of said travel 2. The coating method according to claim 1 wherein an angle $\beta$, which a line extending along a falling direction of said free-falling curtain forms with respect to said web at a said center point, is an obtuse angle not larger than 140°.

* * * * *